US009705173B2

(12) United States Patent
Li et al.

(10) Patent No.: US 9,705,173 B2
(45) Date of Patent: Jul. 11, 2017

(54) WAVEGUIDE STRUCTURE AND MANUFACTURING METHOD THEREOF

(71) Applicant: UNITED MICROELECTRONICS CORP., Hsin-Chu (TW)

(72) Inventors: Tzung-Lin Li, Hsinchu (TW); Chien-Yi Lee, Pingtung County (TW); Chieh-Pin Chang, Hsinchu (TW)

(73) Assignee: UNITED MICROELECTRONICS CORP., Hsin-Chu (TW)

( * ) Notice: Subject to any disclaimer, the term of this patent is extended or adjusted under 35 U.S.C. 154(b) by 304 days.

(21) Appl. No.: 14/602,290

(22) Filed: Jan. 22, 2015

(65) Prior Publication Data

US 2016/0197391 A1 Jul. 7, 2016

(30) Foreign Application Priority Data

Jan. 6, 2015 (TW) ..... 104100327 A

(51) Int. Cl.

| | |
|---|---|
| ***H01P 3/02*** | (2006.01) |
| ***H01P 3/00*** | (2006.01) |
| ***H01P 11/00*** | (2006.01) |
| ***H01P 7/08*** | (2006.01) |

(52) U.S. Cl.

CPC ..... *H01P 3/003* (2013.01); *H01P 3/006* (2013.01); *H01P 3/026* (2013.01); *H01P 7/086* (2013.01); *H01P 11/001* (2013.01)

(58) Field of Classification Search

CPC .. H01P 3/00; H01P 3/003; H01P 3/026; H01P 3/006; H01P 7/086; H01P 11/001

USPC ..... 333/208, 239

See application file for complete search history.

(56) References Cited

U.S. PATENT DOCUMENTS

| | | | | |
|---|---|---|---|---|
| 8,058,953 | B2 * | 11/2011 | Cho | H01P 3/003 257/664 |
| 8,760,245 | B2 | 6/2014 | Mina | |
| 2007/0241844 | A1 * | 10/2007 | Kim | H01P 3/003 333/238 |

* cited by examiner

*Primary Examiner* — Stephen E Jones
*Assistant Examiner* — Rakesh Patel
(74) *Attorney, Agent, or Firm* — Winston Hsu

(57) ABSTRACT

A waveguide structure includes a signal line and two static lines. The signal line is disposed between the static lines in a first direction. The static lines and the signal line are disposed parallel to one another. Each static line includes a first conductive pattern, a second conductive pattern, and a third conductive pattern. The first conductive pattern and the signal line are disposed on an identical plane of a dielectric layer. A thickness of the first conductive pattern is substantially equal to a thickness of the signal line. The second conductive pattern is disposed on the first conductive pattern. A width of the first conductive pattern is larger than a width of the second conductive pattern in the first direction. The third conductive pattern is disposed on the second conductive pattern. A width of the third conductive pattern is larger than the width of the second conductive pattern.

19 Claims, 6 Drawing Sheets

WAVEGUIDE STRUCTURE AND MANUFACTURING METHOD THEREOF

BACKGROUND OF THE INVENTION

1. Field of the Invention

The present invention relates to a waveguide structure and a manufacturing method thereof, and more particularly, to a waveguide structure having a static line with a multi-layer stacked structure and a manufacturing method thereof.

2. Description of the Prior Art

The development of semiconductor integrated circuit technology progresses continuously and circuit designs in products of the new generation become smaller and more complicated than those of the former generation. The amount and the density of the functional devices in each chip region are increased constantly according to the requirements of innovated products, and the size of each device has to become smaller accordingly. Coplanar waveguide (CPW) structures are applied to transmit radio frequency signals in a general integrated circuit. In the CPW structure, widths of ground lines disposed on two sides of a signal line have to be large enough so as to avoid reducing electric field and magnitude of the transmitted signal. However, the width of the ground line directly affects the layout designs of the CPW structure and other components on the same chip of the CPW structure, and the integrity of the integrated circuit becomes hard to be enhanced accordingly.

SUMMARY OF THE INVENTION

It is one of the objectives of the present invention to provide a waveguide structure and a manufacturing method thereof. Static lines with a multi-layer stacked structure are applied to reduce widths of the static lines, and an area of the waveguide structure is reduced accordingly.

A waveguide structure is provided in an embodiment of the present invention. The waveguide structure includes a signal line and two static lines. The signal line is disposed on a dielectric layer. The signal line is disposed between the two static lines in a first direction, and the static lines are disposed parallel to the signal line. Each of the static lines includes a first conductive pattern, a second conductive pattern, and a third conductive pattern. The first conductive pattern is disposed on a same plane of the dielectric layer as the signal line. A thickness of the first conductive pattern is substantially equal to a thickness of the signal line. The second conductive pattern is disposed on the first conductive pattern, and a width of the first conductive pattern in the first direction is larger than a width of the second conductive pattern in the first direction. The third conductive pattern is disposed on the second conductive pattern, and a width of the third conductive pattern in the first direction is larger than the width of the second conductive pattern in the first direction.

A manufacturing method of a waveguide structure is provided in another embodiment of the present invention. The manufacturing method includes following steps. A signal line and two first conductive patterns are formed on a same plane of a dielectric layer. The signal line is formed between the two first conductive patterns in a first direction, and a thickness of each first conductive pattern is substantially equal to a thickness of the signal line. A first insulation layer is then formed on the signal line and the first conductive patterns. At least one trench is then formed, and the trench penetrates the first insulation layer and exposes apart of the first conductive pattern. At least one second conductive pattern is formed in the trench. The trench is filled with the second conductive pattern, and the second conductive pattern directly contacts the first conductive pattern. At least one third conductive pattern is formed on the second conductive pattern and the first insulation layer. The first conductive pattern, the second conductive pattern, and the third conductive pattern are stacked and electrically connected with one another for forming a static line.

In the waveguide structure and the manufacturing method thereof in the present invention, the static line is formed by a multi-layer stacked structure so as to reduce the width of the static line. The area of the waveguide structure may be reduced without influencing the functions and the efficiency of the waveguide structure. The integrity of the circuit and the variety of the layout designs may be enhanced accordingly.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
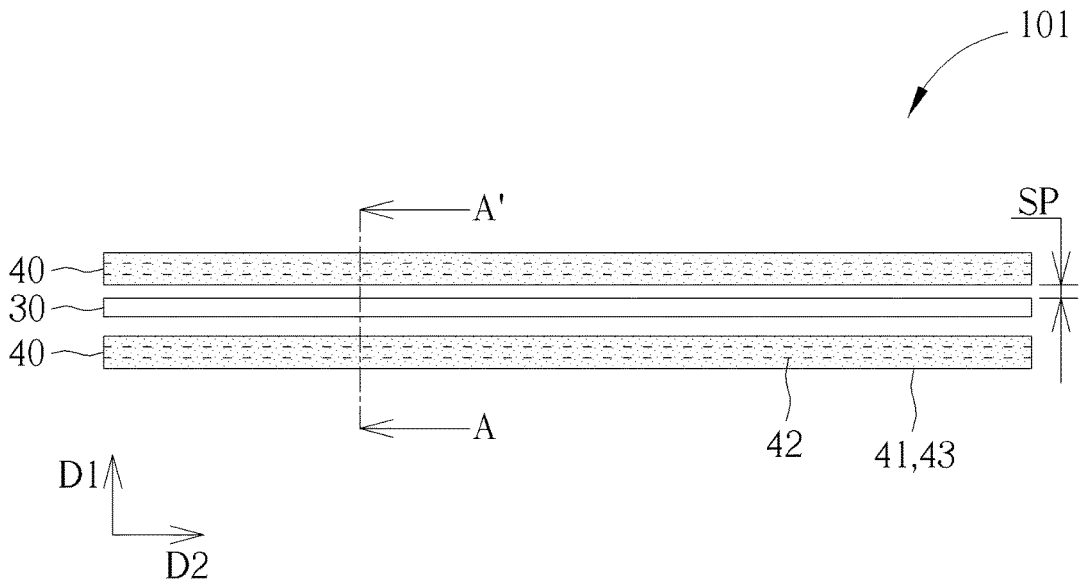
FIG. 1 is a schematic drawing illustrating a top view of a waveguide structure according to a first embodiment of the present invention.
Figure 2:
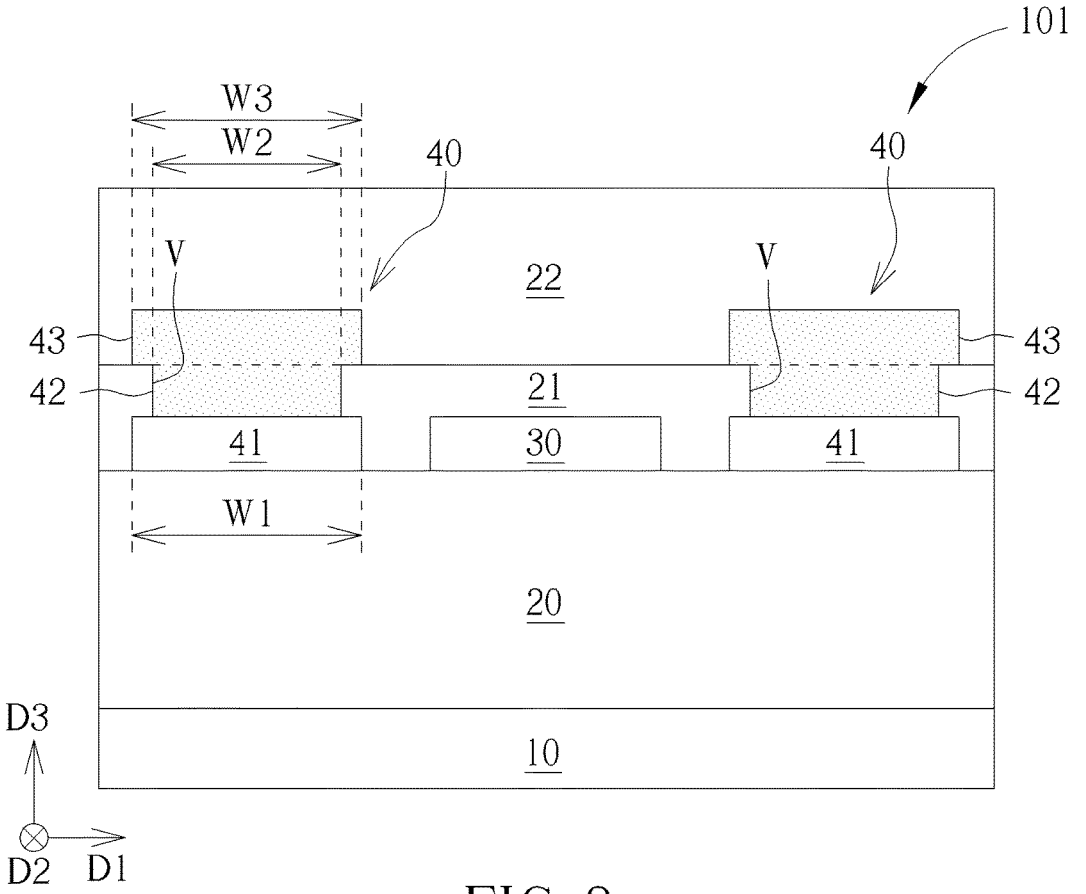
FIG. 2 is a schematic cross-sectional diagram taken along a line A-A' in FIG. 1.

Please refer to FIG. 1 and FIG. 2. FIG. 1 is a schematic drawing illustrating a top view of a waveguide structure according to a first embodiment of the present invention. FIG. 2 is a schematic cross-sectional diagram taken along a line A-A' in FIG. 1. As shown in FIG. 1 and FIG. 2, a waveguide structure 101 is provided in this embodiment. The waveguide structure 101 includes a signal line 30 and two static lines 40. The static lines 40 may be ground lines or electrically connected to a reference voltage, and the signal line 30 accompanied with the static lines 40 may be used to transmit radio frequency (RF) signals or form a matching network. The signal line 30 is disposed on a dielectric layer 20, and the signal line 30 is disposed between the two static lines 40 in a first direction D1. The static lines 40 are disposed parallel to the signal line 30. The signal line 30 and the static lines 40 are electrically insulated from one another. The signal line 30 is isolated from each of the static lines by a spacing SP. In this embodiment, the signal line 30 and the static lines 40 may be straight lines parallel to one another and extending in a second direction D2. The first direction D1 may be substantially perpendicular to the second direction D2, but not limited thereto. Other components (not shown) may be connected to two ends of the waveguide structure 101 in the second direction D2, and signals may be transmitted between the components by the waveguide structure 101 accordingly, but not limited thereto. Additionally, in other embodiment of the present invention, connection lines (not shown) may be selectively disposed on the two ends of the waveguide structure for electrically connecting the two static lines 40 and forming a structure surrounding the signal line 30. In other embodiment of the present invention, the shapes and the extending directions of the signal line 30 and the static lines 40 may be further modified according to positions of the components to be connected, but the signal line 30 is still isolated from the static line 40 by a spacing, the signal line 30 is still electrically insulated from the static lines, and the static lines 30 and the signal line 40 are still disposed parallel to one another.

In this embodiment, each of the static lines 40 includes a first conductive pattern 41, a second conductive pattern 42, and a third conductive pattern 43 disposed in a stacked configuration. The first conductive pattern 41 is disposed on a same plane of the dielectric layer 20 as the signal line 30. A thickness of the first conductive pattern 41 is substantially equal to a thickness of the signal line 30. The first conductive patterns 41 and the signal line 30 may be simultaneously formed on the dielectric layer 20 by performing a patterning process to a conductive layer, but not limited thereto. The second conductive pattern 42 is disposed on the first conductive pattern 41, and the second conductive layer 42 directly contacts the first conductive pattern 41 for being electrically connected to the first conductive pattern 41. The third conductive pattern 43 is disposed on the second conductive pattern 42, and the third conductive layer 43 directly contacts the second conductive pattern 42 for being electrically connected to the second conductive pattern 42. The static line 40 of this embodiment has a multi-layer stacked structure composed of the first conductive pattern 41, the second conductive pattern 42, and the third conductive pattern 43, the total thickness of the static line 40 may become larger than the thickness of the signal line 30 for enhancing the electric field condition between the signal line 30 and the static lines 40, and a width of the static line 40 in the first direction D1 may be reduced accordingly. The area of the waveguide structure 101 may then be reduced without influencing the functions and the efficiency of the waveguide structure 101. In addition, the static lines 40 and the signal line 30 in this embodiment are disposed on the same plane of the dielectric layer 20, and the waveguide structure 101 may be regarded as a coplanar waveguide (CPW) structure. In each of the static lines 40, from a top view of the waveguide structure 101 (as shown in FIG. 1), a length of the first conductive pattern 41, a length of the second conductive pattern 42, and a length of the third conductive pattern 43 in the second direction D2 are equal to one another. Additionally, In the first direction D1, the first conductive pattern 41 has a first width W1, the second conductive pattern 42 has a second W2, and the third conductive pattern 43 has a third width W3. The first width W1 is larger than the second width W2 preferably, and the third width W3 is larger than the second width W2 preferably.

Figure 3:
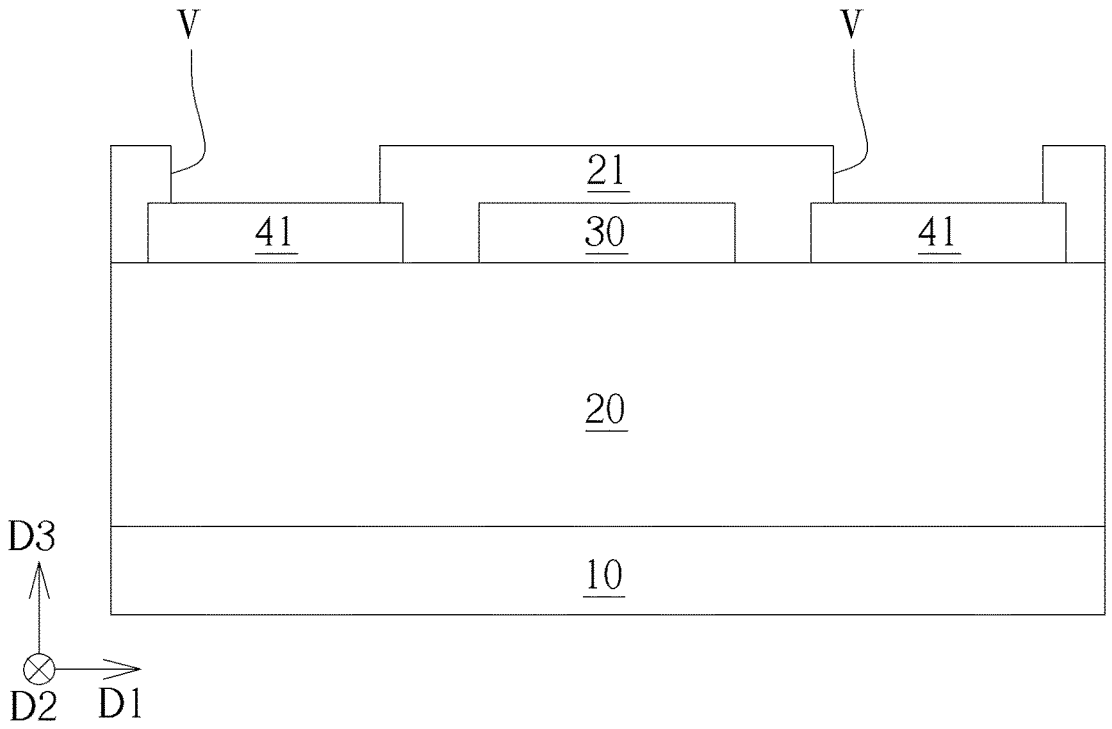
FIG. 3 is a schematic circuit diagram illustrating a manufacturing method of the waveguide structure according to the first embodiment of the present invention.
Figure 4:
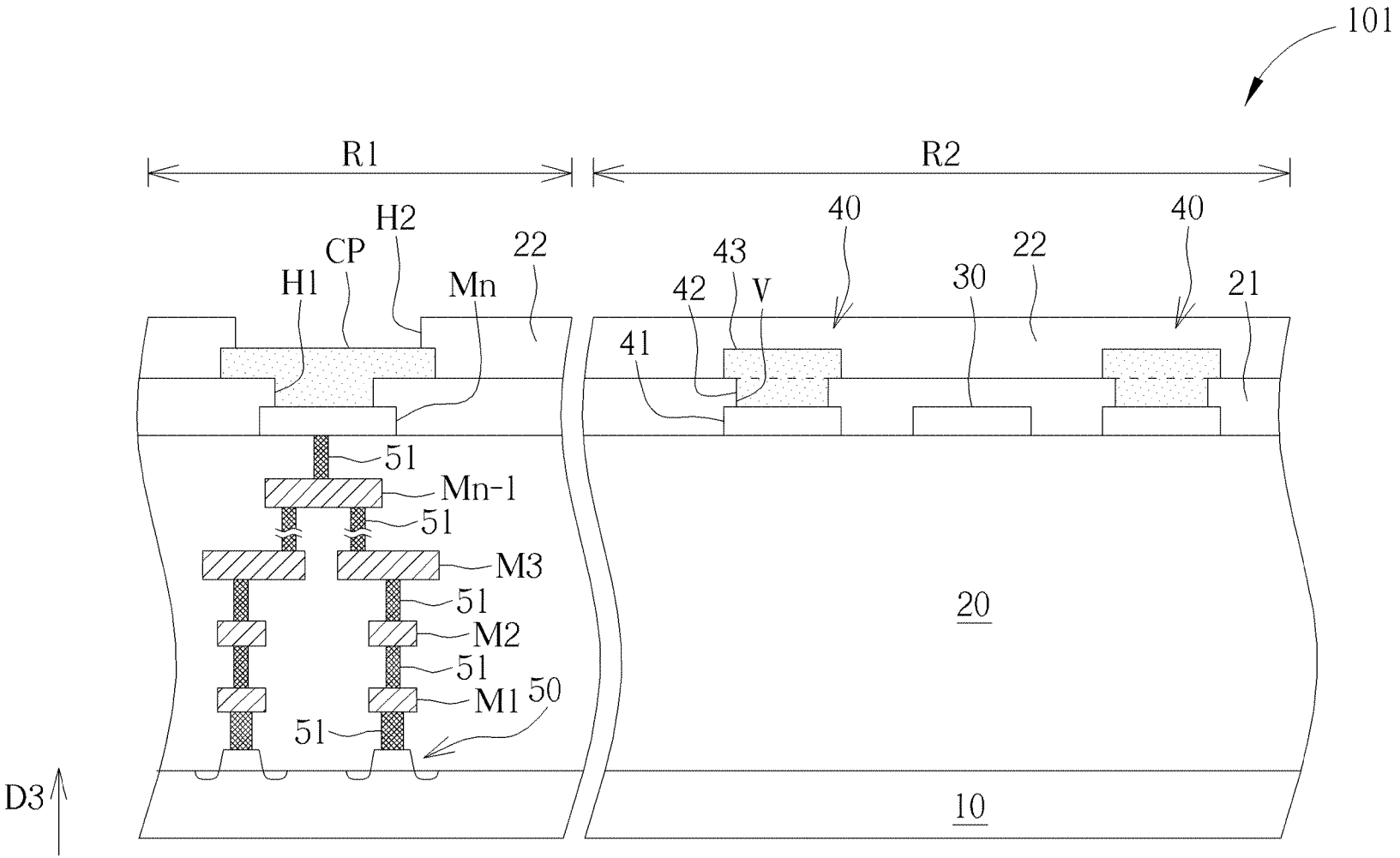
FIG. 4 is a schematic circuit diagram illustrating a disposition condition between the waveguide structure and other components according to the first embodiment of the present invention.

Please refer to FIG. 2, FIG. 3, and FIG. 4. FIG. 3 is a schematic circuit diagram illustrating a manufacturing method of the waveguide structure in this embodiment. FIG. 4 is a schematic circuit diagram illustrating a disposition condition between the waveguide structure and other components in this embodiment. As shown in FIG. 3, the manufacturing method of the waveguide structure in another embodiment includes following steps. One signal line 30 and two first conductive patterns 41 are formed on a same plane of the dielectric layer 20. The signal line 30 is formed between the two first conductive patterns 41 in the first direction D1, and a thickness of each first conductive pattern 41 is substantially equal to the thickness of the signal line 30. The dielectric layer 20 in this embodiment may be made of a plurality of dielectric materials stacked with one another, and the dielectric layer 20 may be disposed on a substrate 10. The substrate 10 may include a silicon substrate, an epitaxial silicon substrate, a silicon germanium substrate, a silicon carbide substrate, or a silicon-on-insulator (SOI) substrate, but not limited thereto. As shown in FIG. 4, other component such as a transistor 50 may be disposed on other region such as a core region R1 on the substrate 10, but there is no other component and/or conductive line disposed underneath the waveguide structure 101 in a vertical projective direction D3 preferably so as to avoid signal interference between the waveguide structure 101 and other components. In other words, the waveguide structure 101 may be disposed on a waveguide region R2 of the substrate 10. Within the waveguide region R2, there is no other component and/or conductive line disposed between the substrate 10 and the waveguide structure 101 or disposed in the substrate 10. Additionally, in the waveguide structure 101, there is no active component and/or conductive line (except the signal line 30) disposed between the two the static lines 40 in the first direction D1. The transistor 50 may be electrically connected to a top metal layer Mn (may also be referred as "last metal") and a contact pad CP on the top metal layer Mn through a conductive path penetrating the dielectric layer 20, and the conductive path may include a plurality of metal layers, such as a first metal layer M1, a second metal layer M2, a third metal layer . . . and a $(n-1)^{th}$ metal layer Mn-1 (n stands for a positive integer larger than or equal to 5) and a plurality of conductive plugs 51 disposed in the dielectric layer 20. In this embodiment, the signal line 30, the first conductive pattern 41, and the top metal layer Mn may be formed at the same time by performing a patterning process to a conductive layer, but not limited thereto. The conductive layer may include aluminum (Al), tungsten (W), copper (Cu), titanium (Ti), or other appropriate conductive materials.

As shown in FIG. 3, a first insulation layer 21 is then formed on the signal line 30 and the first conductive patterns 41. A plurality of trenches V are then formed, and each of the trenches V penetrates the first insulation layer 21 and exposes a part of the first conductive pattern 41. It is worth noting that, as shown in FIG. 4, the first insulation layer 21 may also partially cover the top metal layer Mn, at least one first hole H1 may disposed corresponding to the top metal layer Mn, and the contact pad CP may contact and be electrically connected to the top metal layer Mn through the first hole H1.

Subsequently, as shown in FIG. 2, in the waveguide structure, at least one second conductive pattern 42 is formed in the trench V. The trench V is filled with the second conductive pattern 42, and the second conductive pattern 42 directly contacts the first conductive pattern 41. Afterward at least one third conductive pattern 43 is formed on the second conductive pattern 42 and the first insulation layer 21. The first conductive pattern 41, the second conductive pattern 42, and the third conductive pattern 43 are stacked and electrically connected with one another for forming the static line 40. Relatively, as shown in FIG. 4, in the core region R1, the contact pad CP contacts the top metal layer Mn for forming an electrical connection through the first hole H1 in the first insulation layer 21. The contact pad CP, the second conductive pattern 42, and the third conductive pattern 43 may be formed at the same time by filling the trenches V and the first hole H1 with one conductive layer and performing a patterning process to the conductive layer. Therefore, the second conductive pattern 42 and the third conductive pattern 43 may be monolithically formed by an identical conductive material, but not limited thereto. The conductive layer may also include metal materials such as aluminum, tungsten, copper, and titanium, or other appropriate conductive materials. Additionally, in other embodiments of the present invention, the process of forming the top metal layer Mn or the contact pad CP may also be used to form a redistribution layer (RDL) at the same time. In other words, the redistribution layer (not shown) and the first conductive pattern 41 of the static line 40 or the redistribution layer and the second conductive pattern 42 of the static line 40 may be formed at the same time by performing a patterning process to one conductive layer, but not limited thereto. The static lines 40 in the waveguide structure 102 of this embodiment are formed by the process mentioned above, and the width of the first conductive pattern 41 and the width of the third conductive pattern 43 will be larger than the width of the second conductive pattern 42 accordingly. It is worth noting that a distance between the waveguide structure 101 and the other components on the substrate 10 may become as large as possible by applying the manufacturing method of this embodiment to form the waveguide structure 101, and the problems of signal interference may be avoided accordingly. In addition, as shown in FIG. 4, a second insulation layer 22 may also be selectively formed and cover the third conductive pattern 43, the contact pad CP, and the first insulation layer 21 so as to form a protection effect, but not limited thereto. In the core region R1, a second hole H2 may be formed in the second insulation layer 22, and the second hole H2 is disposed corresponding to the contact pad CP and exposes a part of the contact pad CP for following processes such as a wire bonding process and/or an under bump metallurgy (UBM) process, but not limited thereto.

Figure 5:
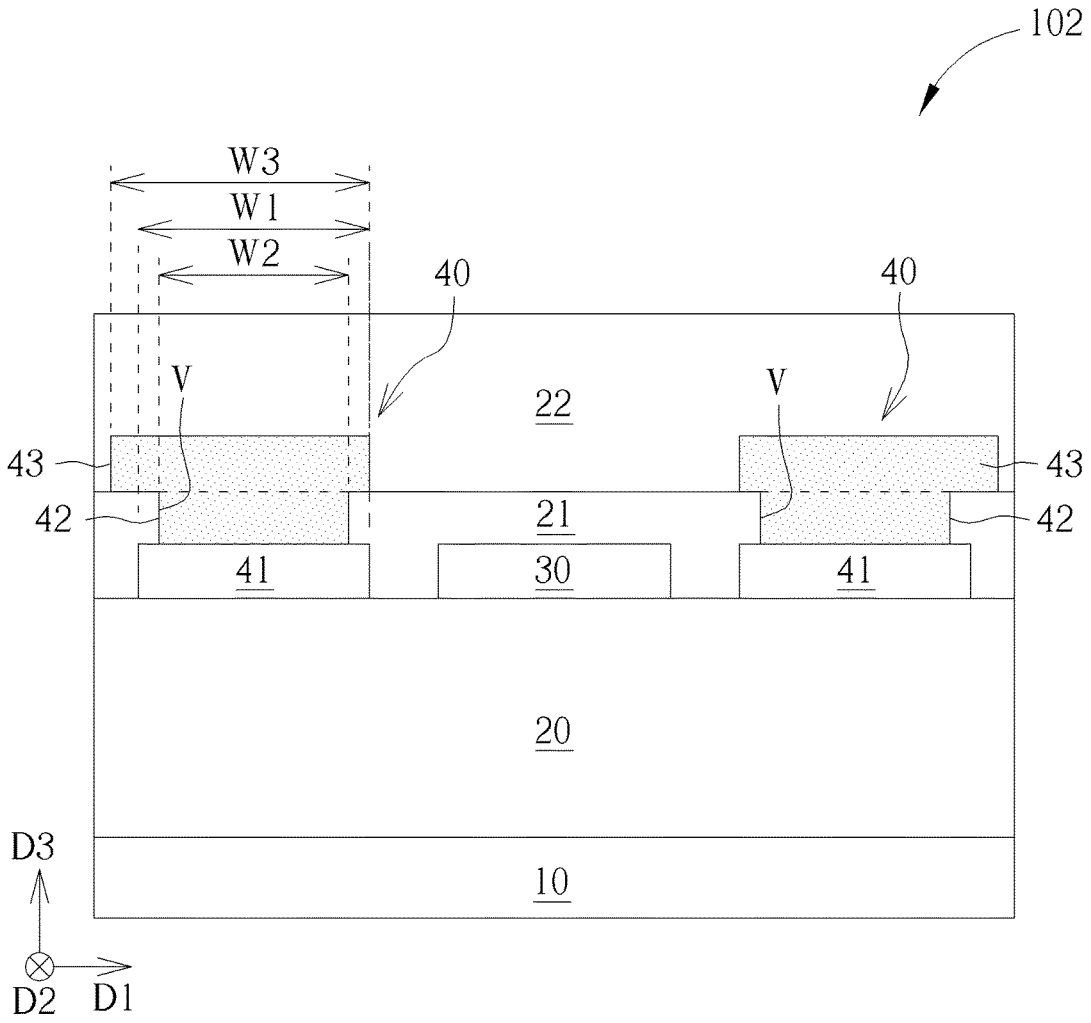
FIG. 5 is a schematic drawing illustrating a waveguide structure according to a second embodiment of the present invention.

Please refer to FIG. 5. FIG. 5 is a schematic drawing illustrating a waveguide structure according to a second embodiment of the present invention. As shown in FIG. 5, a waveguide structure 102 is provided in this embodiment. The difference between the waveguide structure 102 and the waveguide structure in the first embodiment is that, in this embodiment, the width of the third conductive pattern 43 in the first direction D1 is larger than the width of the first conductive pattern W1 in the first direction D1 so as to further enhancing the electric field between the signal line 30 and the static lines 40 without influencing the spacing between the signal line 30 and each static line 40.

Figure 6:
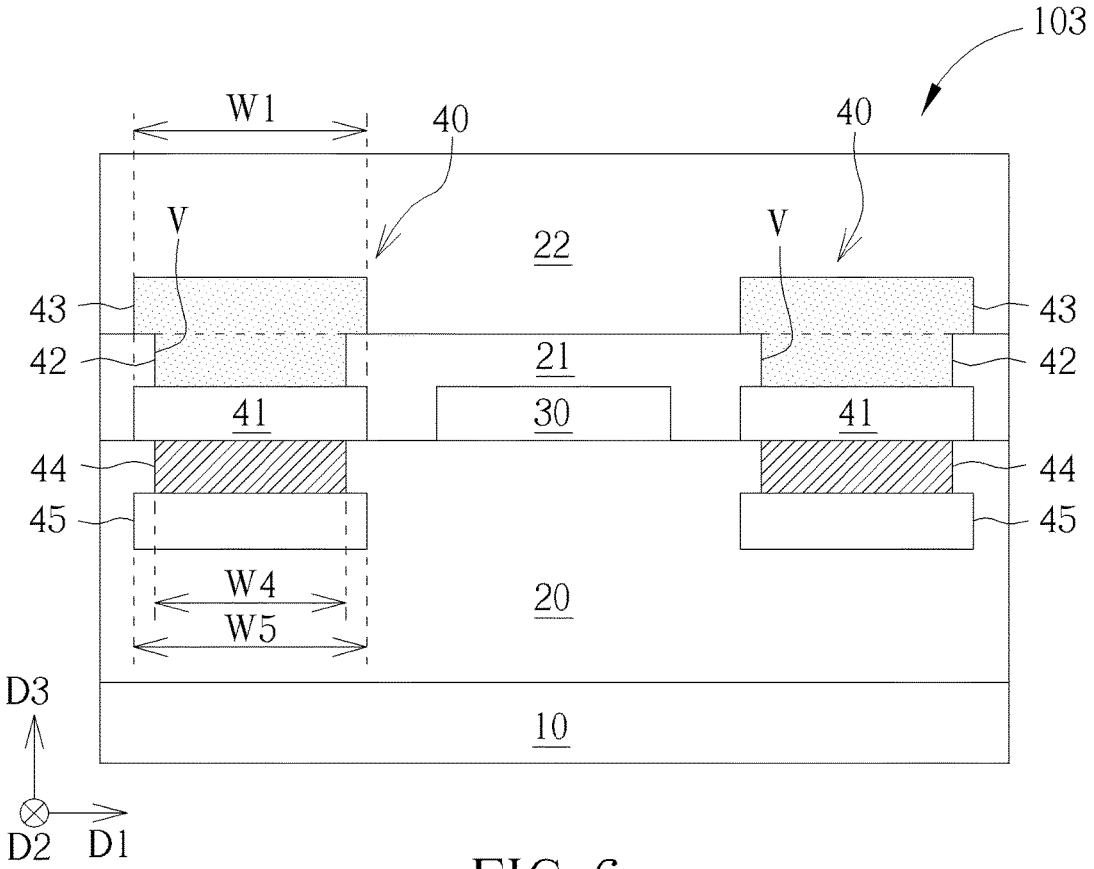
FIG. 6 is a schematic drawing illustrating a waveguide structure according to a third embodiment of the present invention.

Please refer to FIG. 6. FIG. 6 is a schematic drawing illustrating a waveguide structure according to a third embodiment of the present invention. As shown in FIG. 6, a waveguide structure 103 is provided in this embodiment. The difference between the waveguide structure 103 and the waveguide structure in the first embodiment is that each of the static lines 40 in this embodiment may further include a fourth conductive pattern 44 and a fifth conductive pattern 45. The fourth conductive pattern 44 is disposed underneath the first conductive pattern 41, and the fifth conductive pattern 45 is disposed underneath the fourth conductive pattern 44. The fourth conductive pattern 44 directly contacts the first conductive pattern 41, and the fifth conductive pattern 45 directly contacts the fourth conductive pattern 44. The fourth conductive pattern 44 and the fifth conductive pattern are disposed in the dielectric layer 20. In other words, the difference between the manufacturing method in this embodiment and the manufacturing method of the first embodiment is that the manufacturing method of the waveguide structure 103 further includes forming the fourth conductive pattern 44 and the fifth conductive pattern 45 in the dielectric layer 20. The fourth conductive pattern 44 directly contacts the first conductive pattern 41 from a side underneath the first conductive pattern 41, and the fifth conductive pattern 45 directly contacts the fourth conductive pattern 44 from a side underneath the fourth conductive pattern 44. The thickness of the static line 40 in the direction D3 may be increased by the disposition of the fourth conductive pattern 44 and the fifth conductive pattern 45, and the width of the static line 40 may be further reduced accordingly. Additionally, it is worth noting that the fourth conductive pattern 44 in this embodiment and the conductive plug 51 in the above mentioned FIG. 4 may be formed by an identical process, and the fifth conductive pattern 45 in this embodiment and the $(n-1)^{th}$ metal layer Mn-1 may be formed by an identical process. Therefore, the first width W1 of the first conductive pattern 41 in the first direction D1 will be larger than a fourth width W4 of the fourth conductive pattern 44 in the first direction D1, and a fifth width W5 of the fifth conductive pattern 45 in the first direction D1 will be larger than the fourth width W4 of the fourth conductive pattern 45 in the first direction D1.

Figure 7:
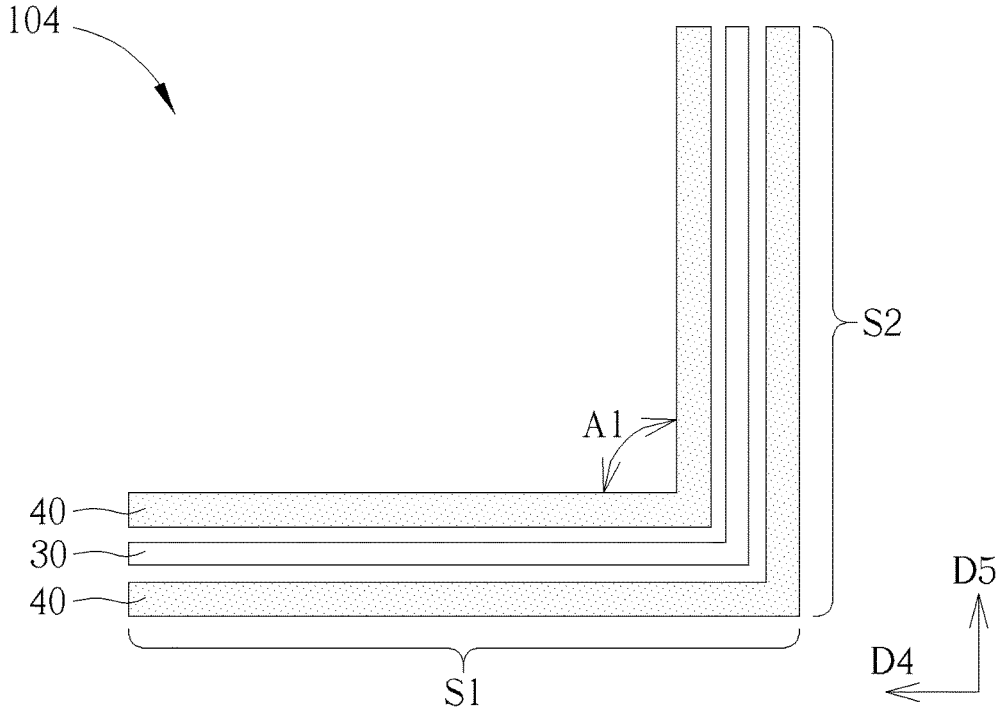
FIG. 7 is a schematic drawing illustrating a top view of a waveguide structure according to a fourth embodiment of the present invention.
Figure 8:
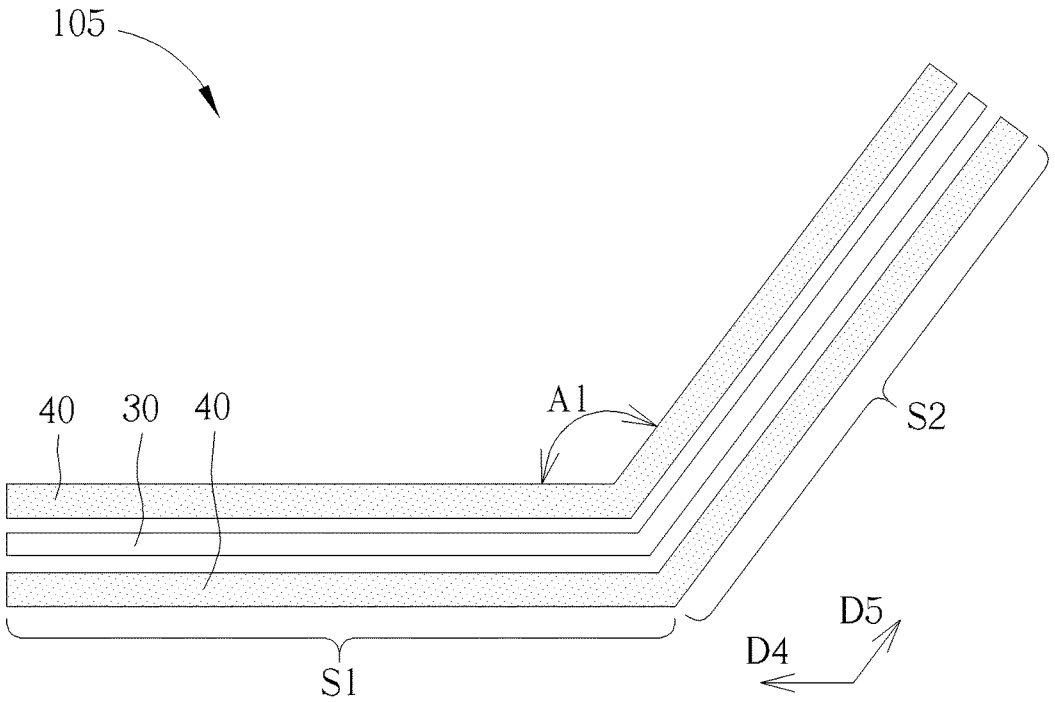
FIG. 8 is a schematic drawing illustrating a top view of a waveguide structure according to a fifth embodiment of the present invention.
Figure 9:
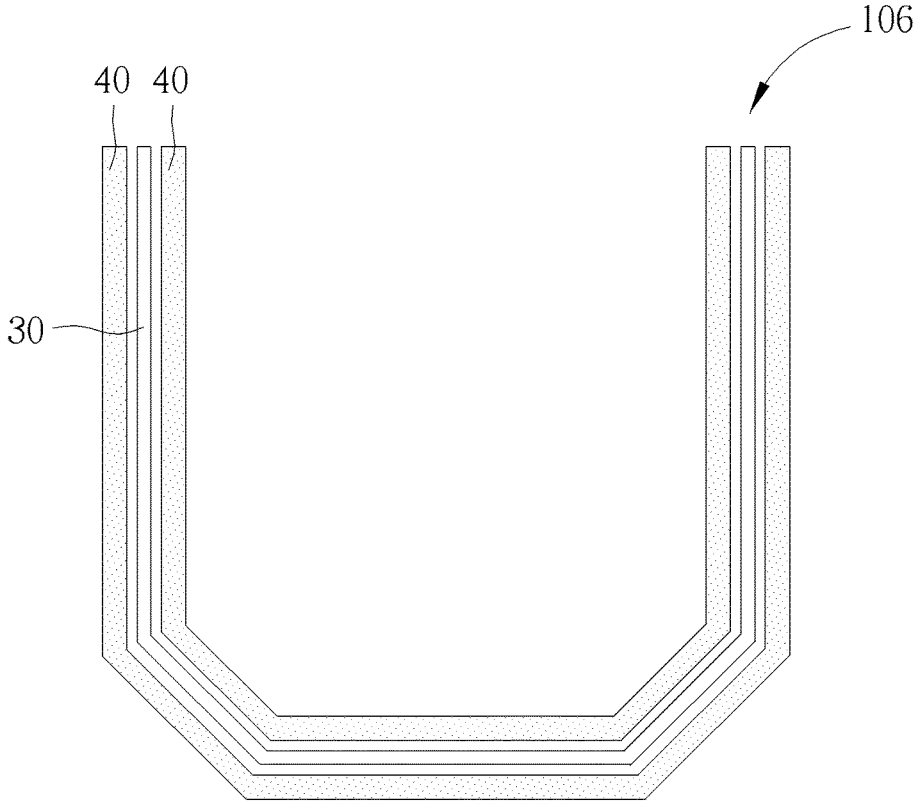
FIG. 9 is a schematic drawing illustrating a top view of a waveguide structure according to a sixth embodiment of the present invention.

Please refer to FIG. 7, FIG. 8, and FIG. 9. FIG. 7 is a schematic drawing illustrating a top view of a waveguide structure 104 according to a fourth embodiment of the present invention. FIG. 8 is a schematic drawing illustrating a top view of a waveguide structure 105 according to a fifth embodiment of the present invention. FIG. 9 is a schematic drawing illustrating a top view of a waveguide structure 106 according to a sixth embodiment of the present invention. As shown in FIG. 7 and FIG. 8, both the waveguide structure 104 and the waveguide structure 105 have a first section S1 and a second section S2. The first section S1 and the second section S2 are connected with each other, and the first section S1 and the second section S2 extend in different directions respectively for being connected to other components. For example, as shown in FIG. 7, the first section S1 extends along a fourth direction D4, and the second section S2 extends along a fifth direction D5. It is worth noting that an included angle A1 between the first section S1 and the second section S2 is equal to 90 degrees (as shown in FIG. 7) or larger than 90 degrees (as shown in FIG. 8, the included angle A1 may be 135 degrees) preferably. Under the design mentioned above, the connection region between the sections in the waveguide structure may not be bent overly and derived negative influence on the signal transmission may be avoided accordingly. In addition, as shown in FIG. 9, the waveguide structure 106 may be a U-shaped pattern having more sections extending in different directions and connected with one another. In other embodiments of the present invention, the shapes and the extending directions of the waveguide structure may be further modified according to other design considerations.

To summarize the above descriptions, in the waveguide structure and the manufacturing method thereof in the present invention, the thickness of the static line may be increased by the stacked conductive patterns, and the electric field between the signal line and the static lines may be enhanced accordingly. The width of the static line and the total width of the waveguide structure may also be reduced relatively. The area of the waveguide structure may be reduced without influencing the functions and the efficiency of the waveguide structure, and the integrity of the circuit and the variety of the layout designs may be enhanced accordingly.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A waveguide structure, comprising:

a signal line disposed on a dielectric layer; and two static lines, wherein the signal line is disposed between the two static lines in a first direction, the two static lines are disposed parallel to the signal line, and each of the static lines comprises:

a first conductive pattern disposed on a same plane of the dielectric layer as the signal line, wherein a thickness of the first conductive pattern is substantially equal to a thickness of the signal line;

a second conductive pattern disposed on the first conductive pattern, wherein a width of the first conductive pattern in the first direction is larger than a width of the second conductive pattern in the first direction; and a third conductive pattern disposed on the second conductive pattern, wherein a width of the third conductive pattern in the first direction is larger than the width of the second conductive pattern in the first direction, and a topmost surface of the signal line is lower than a topmost surface of each of the two static lines.

2. The waveguide structure according to claim 1, wherein from a top view of the waveguide structure, the signal line and the two static lines are straight lines parallel to one another.

3. The waveguide structure according to claim 1, wherein there is no active component disposed between the two static lines in the first direction.

4. The waveguide structure according to claim 1, wherein the width of the respective third conductive patterns in the first direction is larger than the width of the corresponding first conductive pattern in the first direction.

5. The waveguide structure according to claim 1, wherein each of the static lines further comprises a fourth conductive pattern disposed underneath the corresponding first conductive pattern, the fourth conductive pattern directly contacts the corresponding first conductive pattern, and the fourth conductive pattern is disposed in the dielectric layer.

6. The waveguide structure according to claim 5, wherein the width of the respective first conductive patterns in the first direction is larger than a width of the corresponding fourth conductive pattern in the first direction.

7. The waveguide structure according to claim 5, wherein each of the static lines further comprises a fifth conductive pattern disposed underneath the corresponding fourth conductive pattern, the fifth conductive pattern directly contacts the corresponding fourth conductive pattern, and the fifth conductive pattern is disposed in the dielectric layer.

8. The waveguide structure according to claim 7, wherein a width of respective the fifth conductive patterns in the first direction is larger than a width of the corresponding fourth conductive pattern in the first direction.

9. The waveguide structure according to claim 1, wherein from a top view of the waveguide structure, the waveguide structure has a first section and a second section, the first section and the second section are connected with each other, and the first section and the second section extend in different directions respectively.

10. The waveguide structure according to claim 9, wherein an included angle between the first section and the second section is larger than or equal to 90 degrees.

11. The waveguide structure according to claim 1, wherein from a top view of the waveguide structure, the waveguide structure is a U-shaped pattern.

12. The waveguide structure according to claim 1, wherein the two static lines are ground lines or electrically connected to a reference voltage.

13. The waveguide structure according to claim 1, wherein from a top view of the waveguide structure, a length of the respective first conductive patterns is equal to a length of the corresponding second conductive pattern.

14. A method for manufacturing a waveguide structure, comprising:

forming a signal line and two first conductive patterns on a same plane of a dielectric layer, wherein the signal line is formed between the two first conductive patterns in a first direction, and a thickness of each first conductive pattern is substantially equal to a thickness of the signal line;

forming a first insulation layer on the signal line and the two first conductive patterns;

forming at least one trench penetrating the first insulation layer and exposing a part of one of the two first conductive patterns;

forming at least one second conductive pattern in the trench, wherein the trench is filled with the at least one second conductive pattern, and the at least one second conductive pattern directly contacts the first conductive pattern corresponding to the at least one trench; and forming at least one third conductive pattern on the at least one second conductive pattern and the first insulation layer, wherein the first conductive pattern corresponding to the at least one trench, the at least one second conductive pattern, and the at least one third conductive pattern are stacked and electrically connected with one another for forming a static line, and a topmost surface of the signal line is lower than a topmost surface of the static line.

15. The method for manufacturing the waveguide structure according to claim 14, wherein the at least one second conductive pattern and the at least one third conductive pattern are monolithically formed by an identical conductive material.

16. The method for manufacturing the waveguide structure according to claim 14, wherein a width of the first conductive pattern corresponding to the at least one trench in the first direction is larger than a width of the at least one second conductive pattern in the first direction, and a width of the at least one third conductive pattern in the first direction is larger than the width of the at least one second conductive pattern in the first direction.

17. The method for manufacturing the waveguide structure according to claim 16, wherein the width of the at least one third conductive pattern in the first direction is larger than the width of the first conductive pattern corresponding to the at least one trench in the first direction.

18. The method for manufacturing the waveguide structure according to claim 14, further comprising forming a fourth conductive pattern, wherein the fourth conductive pattern directly contacts the first conductive pattern corresponding to the at least one trench from a side underneath the first conductive pattern corresponding to the at least one trench, the fourth conductive pattern is formed in the dielectric layer, and a width of the first conductive pattern corresponding to the at least one trench in the first direction is larger than a width of the fourth conductive pattern in the first direction.

19. The method for manufacturing the waveguide structure according to claim 18, further comprising forming a fifth conductive pattern, wherein the fifth conductive pattern directly contacts the fourth conductive pattern from a side underneath the fourth conductive pattern, the fifth conductive pattern is formed in the dielectric layer, and a width of the fifth conductive pattern in the first direction is larger than the width of the fourth conductive pattern in the first direction.

* * * * *